US005211788A

United States Patent [19]

Song

[11] Patent Number: 5,211,788

[45] Date of Patent: May 18, 1993

[54] TENNIS BALL AND METHOD OF MANUFACTURING THE SAME

[76] Inventor: Jae M. Song, 807-8, Bangbae-dong, Seocho-ku, Seoul, Rep. of Korea

[21] Appl. No.: 841,278

[22] Filed: Feb. 26, 1992

Related U.S. Application Data

[63] Continuation of Ser. No. 382,450, Jul. 20, 1989, abandoned.

[30] Foreign Application Priority Data

Aug. 10, 1988 [KR] Rep. of Korea ..... 10171

[51] Int. Cl.[5] ..... A63B 39/06; B29C 65/48

[52] U.S. Cl. ..... 156/148; 156/213; 273/61 B

[58] Field of Search ..... 156/148, 213, 153; 28/107, 112; 273/61 R, 61 B; 428/91, 92, 93, 94, 300

[56] References Cited

U.S. PATENT DOCUMENTS

| | | | |
|---|---|---|---|
| 2,952,063 | 9/1960 | Bukalders et al. | 273/61 R |
| 3,074,144 | 1/1963 | Reed | 273/61 B |
| 3,396,970 | 8/1968 | Fraser et al. | 156/148 |
| 3,684,284 | 8/1972 | Tranfield | 156/148 |

FOREIGN PATENT DOCUMENTS

| | | | |
|---|---|---|---|
| 0279254 | 9/1964 | Australia | 273/61 B |
| 145 | 2/1981 | Rep. of Korea . | |
| 10182 | 2/1981 | Rep. of Korea . | |
| 1074779 | 7/1967 | United Kingdom | 156/148 |
| 1229781 | 4/1971 | United Kingdom | 273/61 B |

*Primary Examiner*—Caleb Weston
*Assistant Examiner*—Steven D. Maki
*Attorney, Agent, or Firm*—Armstrong, Nikaido, Marmelstein, Kubovcik & Murray

[57] ABSTRACT

A tennis ball comprising a hollow, spherical rubber ball (2) and a felt covering (4) attached to the rubber ball by an adhesive, characterized in that the felt covering is cut out from a felted fabric manufactured through steps of knitting a circular knitted high-pile fabric by laying blended slivers of wool fibers and nylon fibers in a circular knitted fabric in knitting the latter on a circular knitting machine so that the component fibers of the blended sliver extend as pile fibers on one surface of the base portion of the circular knitted high-pile fabric, needle-punching the circular knitted fabric so that each pile fiber is anchored at least at two parts thereof to the other surface of the base portion, and milling the needle-punched circular knitted high-pile fabric.

1 Claim, 2 Drawing Sheets

TENNIS BALL AND METHOD OF MANUFACTURING THE SAME

This application is a continuation of application Ser. No. 382,450 filed Jul. 20, 1989, now abandoned.

BACKGROUND OF THE INVENTION

1. Field of the Invention

The present invention relates to a tennis ball having excellent durability and elasticity, and well balanced flexibility and firmness, and a method of manufacturing such a tennis ball.

2. Description of the Related Art

A tennis ball formed by coating a hollow, spherical rubber ball with raised felt is disclosed in Korean Patent Publication No. 550, pp. 75–78. Such a tennis ball coated with raised felt has the following drawbacks.

In manufacturing raised felt by subjecting felt to a raising process, excessive raising damages the felt, and hence the area of raising is limited, in general, to 50 to 60% of the surface of the felt. A tennis ball coated with such an insufficiently raised felt is unsatisfactory in elasticity and abrasion resistance. Furthermore, since the raised fibers are held simply at the opposite extremities by the base portion, the raised fibers are liable to fall off the base portion to deteriorate the durability of the ball.

SUMMARY OF THE INVENTION

Accordingly, it is an object of the present invention to eliminate the foregoing drawbacks of the prior art and to provide a tennis ball coated with a felted circular knitted pile fabric processed through a special treatment and having excellent durability and elasticity.

It is a further object of the present invention to provide a method of manufacturing such an excellent tennis ball.

To achieve the objects of the invention, the present invention provides a tennis ball comprising a hollow, spherical rubber ball, and a felt coating entirely covering the hollow, spherical rubber ball, characterized in that a fabric for the felt coating is manufactured by subjecting a circular knitted high-pile fabric with blended slivers of wool and nylon fibers laid in so as to be exposed on one surface of the fabric to a needle-punching process to anchor the respective pile fiber at least at two parts thereof on the other surface of the fabric, and subjecting the thus needle-punched fabric to a milling process.

The present invention also provides a method of manufacturing a tennis ball comprising steps of: knitting a tubular knitted high-pile fabric with blended slivers of wool and nylon fibers laid in so as to be exposed on one surface of the fabric; brushing the surface of the circular knitted high-pile fabric so that the pile fibers are inclined regularly in one direction at an angle to the surface of the circular knitted high-pile fabric; needle-punching the brushed circular knitted high-pile fabric so that each pile fiber is anchored on the backside of the circular knitted high-pile fabric at least at two parts thereof; milling the needle-punched tubular knitted high-pile fabric to obtain a felted coating fabric; and adhesively coating a hollow, spherical rubber ball with the felted coating fabric.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENTS

Figure 1:
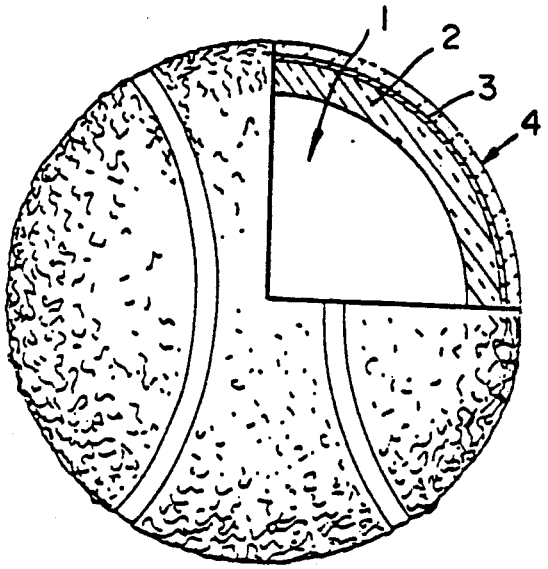
FIG. 1 is a partially cutaway front elevation of a tennis ball embodying the present invention.

Referring to FIG. 1, a tennis ball embodying the present invention is formed by adhesively coating a hollow, spherical rubber ball 2 having a sealed space 1 with a felt covering 4. The felt covering 4 is attached to the outer surface of the rubber ball 2 by an adhesive film 3. This construction of the tennis ball is substantially the same as that of a conventional tennis ball. The present invention is featured by the construction of a felted fabric for the felt coating 4 and a method of manufacturing the felted fabric.

The felt covering 4 is cut out from a felted fabric obtained by processing a circular knitted high-pile fabric with blended slivers of wool and nylon fibers laid in so as to be exposed on one surface thereof as pile fibers. The surface of the tubular knitted high-pile fabric is brushed to arrange the pile fibers so as to be inclined regularly in one direction at an inclination to prepare the tubular knitted high-pile fabric to achieve the subsequent needle-punching process effectively.

Figure 2:
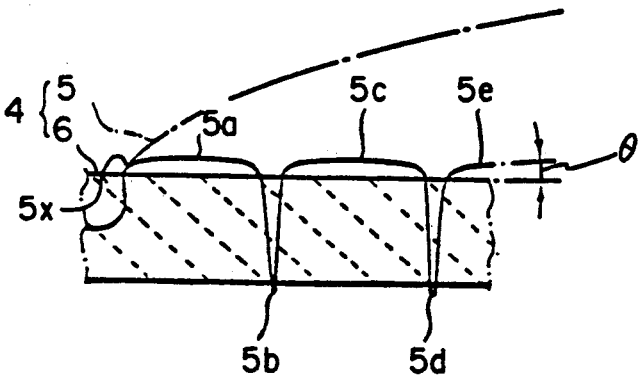
FIG. 2 is a diagrammatic illustration of a felted coating fabric, showing the arrangement of a pile fabric.
Figure 3:
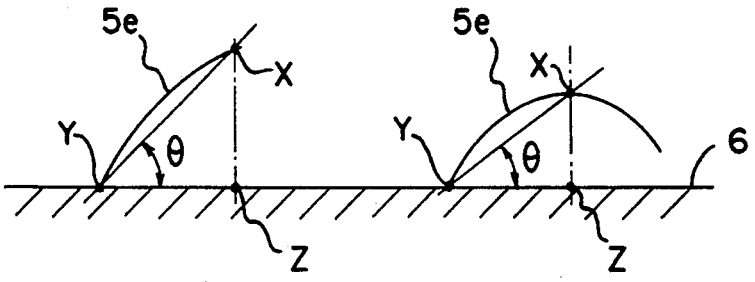
FIG. 3 is an illustration of assistance in explaining the definition of a maximum inclination $\theta$ of a pile fiber having a free end.

The brushed tubular knitted high-pile fabric is needle-punched to push in the inclined pile fibers partially into the base portion 6 of the tubular knitted high-pile fabric as shown in FIG. 2.

Referring to FIG. 2, each pile fiber 5 is secured only at the root 5*x* thereof to the base portion 6 as indicated by an alternate long and short dash line before needle-punching. The pile fiber 5 is inserted in the base portion 6 at least at two parts thereof by needle-punching and is anchored to the base portion 6 at parts 5*b* and 5*d* projecting from the backside of the base portion 6. Thus, the pile fiber 5 extends in two low loop piles 5*a* and 5*c*, and a comparatively short pile 5*e* having a free end (hereinafter referred to as "free pile").

Subsequently, the needle-punched tubular knitted high-pile fabric is subjected to a known felting process for fulling to obtain a felted fabric for the felt covering 4.

The free piles 5*e* extend respectively at different maximum inclinations $\theta$ in the range of 0° to 90° to cover the surface of the base portion. The maximum inclination $\theta$ is an angle XYZ, where the point X is the highest point on the short pile 5*e*, the point Y is the root of the short pile 5*e*, and the point Z is the point of intersection of the surface of the base portion and a perpendicular to the surface of the base portion, passing the point X.

The degree of needle-punching is dependent on the fiber length of the pile fibers. It is desirable to anchor a comparatively long pile fiber at least at three parts thereof. The duration of the milling process is regulated so that a finished felted fabric has desired firmness or flexibility.

Although the construction of the nap of the felted fabric has been described typically with reference to FIG. 2 showing only one of the pile fibers 5, actually, the nap consists of numerous pile fibers 5. A tennis ball coated with such a felt covering 4 having the low loop piles 5*a* and 5*c*, and the comparatively short free piles 5*e* mixed in a predetermined ratio is a novel tennis ball which has never been proposed previously.

The following process conditions for manufacturing such a felted fabric for the felt covering 4 was found to be desirable through studies.

1) Preferably, the blended sliver contains 60 to 80% by weight wool fibers and 20 to 40% by weight nylon fibers or, most desirably, 65% by weight wool fibers and 35% by weight nylon fibers.

2) An appropriate length of the free portion of the pile fibers 5 before needle-punching is in the range of 2 to 6 cm. When the free length is less than 2 cm, it is difficult to anchor the pile fiber at two or more parts thereof, and hence the pile fiber 5 is liable to fall off the base portion. Furthermore, reduction in the number of anchored parts, hence the number of the loop piles 5*a* and 5*c*, reduces the elasticity of the felt covering 4 adversely. On the other hand, pile fibers having a fiber length greater than 6 cm increases the thickness and weight of the felt covering 4 excessively.

3) An appropriate length of projection of the anchored parts is in the range of 1.5 to 2.5 mm. When the length of projection is less than 1.5 mm, the pile fibers are not anchored securely. When the length of projection exceeds 2.5 mm, the thickness of the felt covering 4 increases excessively.

4) The blended silver is laid in the circular knitted high-pile fabric by an amount sufficient to form a nap over the entire surface of the base portion.

5) The tubular knitted fabric forming the base portion is formed of 100% polyester spun yarns, polyester-cotton blended spun yarns, polyester or nylon multifilament yarns, polyester or nylon texturized multifilament yarns, or polyester or nylon multifilament yarns and polyester and nylon texturized multifilament yarns.

A preferable weight ratio between the pile fibers and the base portion, i.e., the tubular knitted fabric, is 4 to 1.

6) The needle-punched tubular knitted high-pile fabric may be processed by the conventional milling process. Process conditions of the milling process is determined so that the felted fabric is finished in desired firmness and elasticity.

The felt covering 4 thus obtained is attached by the adhesive layer 3 to the surface of the hollow, spherical rubber ball 2 to complete the tennis ball of the present invention.

The performance of the tennis ball thus manufactured in accordance with the present invention will be described hereinafter.

The felt covering 4 cut out from the felted fabric obtained by processing the tubular knitted high-pile fabric has a surface entirely covered with a nap of overlapping pile fibers 5. The felt covering 4 is featured by the numerous free piles 5*e* and is conspicuously different from the conventional raised felt coating. The free piles 5*e* function just like springs to provide the tennis ball with a moderate elasticity. Furthermore, the extension of the free piles 5*e* at different inclinations $\theta$ in the range of 0° to 90° further enhances of the effect of the free piles 5*e* on the elasticity of the tennis ball.

The loop piles 5*a* and 5*c* overlapping each other in multiple layers cover the entire surface of the base portion completely, whereas the pile fibers of the conventional felt coating cover the surface of the base portion in a single layer at a surface covering ratio in the range of 50 to 60%. It is obvious from the fact that the felt coating of the present invention is superior to the conventional felt coating.

The springy function of the free piles 5*e* in combination with the satisfactory covering function of the overlapping loop piles 5*a* and 5*c* gives the tennis ball excellent flexibility and elasticity. Furthermore, since each pile fiber 5 is anchored at least at two parts 5*b* and 5*d* to the backside of the base portion and the adjacent loop piles overlap each other, the felt coating 4 has a sufficient durability. Moreover, the weight of the felt coating 4 can properly be determined by selectively deciding the type of fibers for forming the circular knitted high-pile fabric.

The present invention will be described more concretely with reference to an example of a tennis ball in accordance with the present invention.

Blended slivers of 5 mm in diameter containing 65% by weight wool fibers and 35% by weight nylon fibers were produced by a known spinning process. Polyesters spun yarns of Nc 30's were knitted on a high-pile knitting machine in a plain knitted fabric while the blended slivers were laid in the plain knitted fabric to obtain a tubular knitted high-pile fabric having piles of 5 cm in length. The tubular knitted high-pile fabric was slit and was subjected to a shearing process to make the pile fibers uniform in length. Then, the surface of the tubular knitted high-pile fabric was brushed to extend the pile fibers in the same direction respectively at inclinations on the order of 5°. Then, the tubular knitted high-pile fabric was subjected to a needle punching process, in which the circular knitted high-pile fabric was needle-punched at a needle-punching density of 200 needles per square centimeter so that anchored parts of the pile fibers project from the backside of the fabric by about 2 mm. Subsequently, the needle-punched tubular knitted high-pile fabric was subjected to a milling process for fulling, and then the felted tubular knitted high-pile fabric was dried for finishing.

A felt coating was cut out from the felted tubular knitted high-pile fabric and attached adhesively to the surface of a hollow, spherical rubber ball to obtain a tennis ball.

As is apparent from the foregoing description, a tennis ball in accordance with the present invention is coated with a unique tubular knitted high-pile fabric finished by needle-punching and felting and having overlapping pile fibers securely anchored to the ground texture and perfectly covering the surface thereof. Accordingly, the tennis ball has excellent elasticity and flexibility, and an extended life.

I claim:

1. A method of a manufacturing a tennis ball, comprising the steps of:

producing a tubular knitted high-pile fabric having a base layer and a plurality of laid in pile fibers by knitting yarn material on a circular knitting machine to form said base layer and laying a plurality of component fibers comprising blended slivers of wool fiber and nylon fibers in an outer surface of said base portion to provide said plurality of laid in pile fibers;

brushing said tubular knitted high-pile fabric on a side thereof having said plurality of laid in pile fibers to arrange said plurality of laid in pile fibers so as to extend regularly in one direction at an inclination relative to said outer surface of said base portion;

needle-punching said tubular knitted high-pile fabric so that each of said plurality of laid in pile fibers is anchored at least at two parts thereof to an inner surface of said base portion of said tubular knitted high-pile fabric;

milling the needle-punched tubular knitted high-pile fabric to obtain a felted fabric;

cutting out a felt covering from said felted fabric; and attaching said felt covering to a hollow, spherical rubber ball by an adhesive so that said hollow, spherical rubber ball is entirely covered by said felt covering to form a tennis ball.

* * * * *